US008375832B2

(12) United States Patent
Chen

(10) Patent No.: US 8,375,832 B2
(45) Date of Patent: Feb. 19, 2013

(54) COMPACT ONE TOUCH PNEUMATIC WRENCH

(75) Inventor: Chi-Chen Chen, Taiping (TW)

(73) Assignee: Year Congratulate Industrial Co., Ltd., Taichung Hsien (TW)

( * ) Notice: Subject to any disclaimer, the term of this patent is extended or adjusted under 35 U.S.C. 154(b) by 391 days.

(21) Appl. No.: 12/766,070

(22) Filed: Apr. 23, 2010

(65) Prior Publication Data

US 2011/0259155 A1 Oct. 27, 2011

(51) Int. Cl.
*E21B 3/00* (2006.01)

(52) U.S. Cl. ..... 81/463; 173/221; 81/57.44

(58) Field of Classification Search ..... 81/463–465, 81/57.42, 57.44; 173/170, 218, 221
See application file for complete search history.

(56) References Cited

U.S. PATENT DOCUMENTS 4,553,948 A * 11/1985 Tatsuno ..... 173/93.5
4,785,693 A * 11/1988 Minamiyama et al. ..... 81/465
6,935,437 B2 * 8/2005 Izumisawa ..... 173/93

* cited by examiner

*Primary Examiner* — Hadi Shakeri
(74) *Attorney, Agent, or Firm* — Ming Chow; Sinorica, LLC

(57) ABSTRACT

A compact one touch pneumatic wrench includes a cylinder having an improved air passage to achieve one touch function and a housing mad of engineering plastic material. Compared to a conventional pneumatic wrench which needs one hand to hold the handle and the other hand to operate the clockwise/counterclockwise rotation of the motor, the present invention improves the air passage of the cylinder to provide a simple and convenient operation with only one hand, providing a convenient operation and enhancing the work efficiency.

7 Claims, 16 Drawing Sheets

A-A

COMPACT ONE TOUCH PNEUMATIC WRENCH

BACKGROUND OF THE INVENTION

1. Field of the Invention

The present invention relates to a compact one touch pneumatic wrench, and more particularly to a cylinder having an improved air passage to achieve one touch function and a housing mad of engineering plastic material.

2. Description of the Prior Art

The work principle of a pneumatic wrench is that compressed air passes through a speed adjustment mechanism and enters a cylinder for pushing blades to rotate and drive a rotor. A percussion mechanism is to generate alteration impact loading of transient high energy. Due to great twisting movement and better safety, pneumatic wrenches are widely used to assemble productions lines and disassemble nuts.

As shown in FIG. 13, a conventional pneumatic wrench comprises a speed adjustment mechanism and a rotating mechanism which are separated from a cylinder. Compressed air enters the cylinder for pushing blades to rotate and drive a rotor. A percussion mechanism is to generate twisting movement. The speed adjustment mechanism is separated from the cylinder, its outer housing must be made of metallic material, and airtight processing must be done to ensure an airtight passage. This conventional wrench is larger in size and heavy and the cost is high. Accordingly, the inventor of the present invention has devoted himself based on his many years of practical experiences to improve the aforesaid problems of the conventional pneumatic wrench.

SUMMARY OF THE INVENTION

The primary object of the present invention is to provide an improved cylinder air passage. A cylinder has a circular hole at a rear end thereof. An air valve sleeve hole, a clockwise rotation air slot, a counterclockwise rotation air slot, a first air outlet, a second air outlet, a first through hole, a second through hole, a bottom air inlet and a sealed groove are disposed in the cylinder. The first through hole and the second through hole are tightly sealed through a fastener. The clockwise rotation air slot and the counterclockwise rotation air slot communicate with a chamber. The first through hole communicates with the counterclockwise rotation air slot. The second through hole communicates with the clockwise rotation air slot. The first air outlet, the second air outlet and the bottom air inlet communicate with an air valve sleeve hole. The bottom air inlet is surrounded by the sealed groove and sealed by a washer. The cylinder engages with the housing tightly. A housing is made of engineering plastic material. The compact one touch pneumatic wrench of the present invention provides one touch function, with a single hand to hold the handle and to switch a clockwise/counterclockwise rotation of a motor.

DETAILED DESCRIPTION OF THE PREFERRED EMBODIMENTS

Embodiments of the present invention will now be described, by way of example only, with reference to the accompanying drawings.

Figure 1:
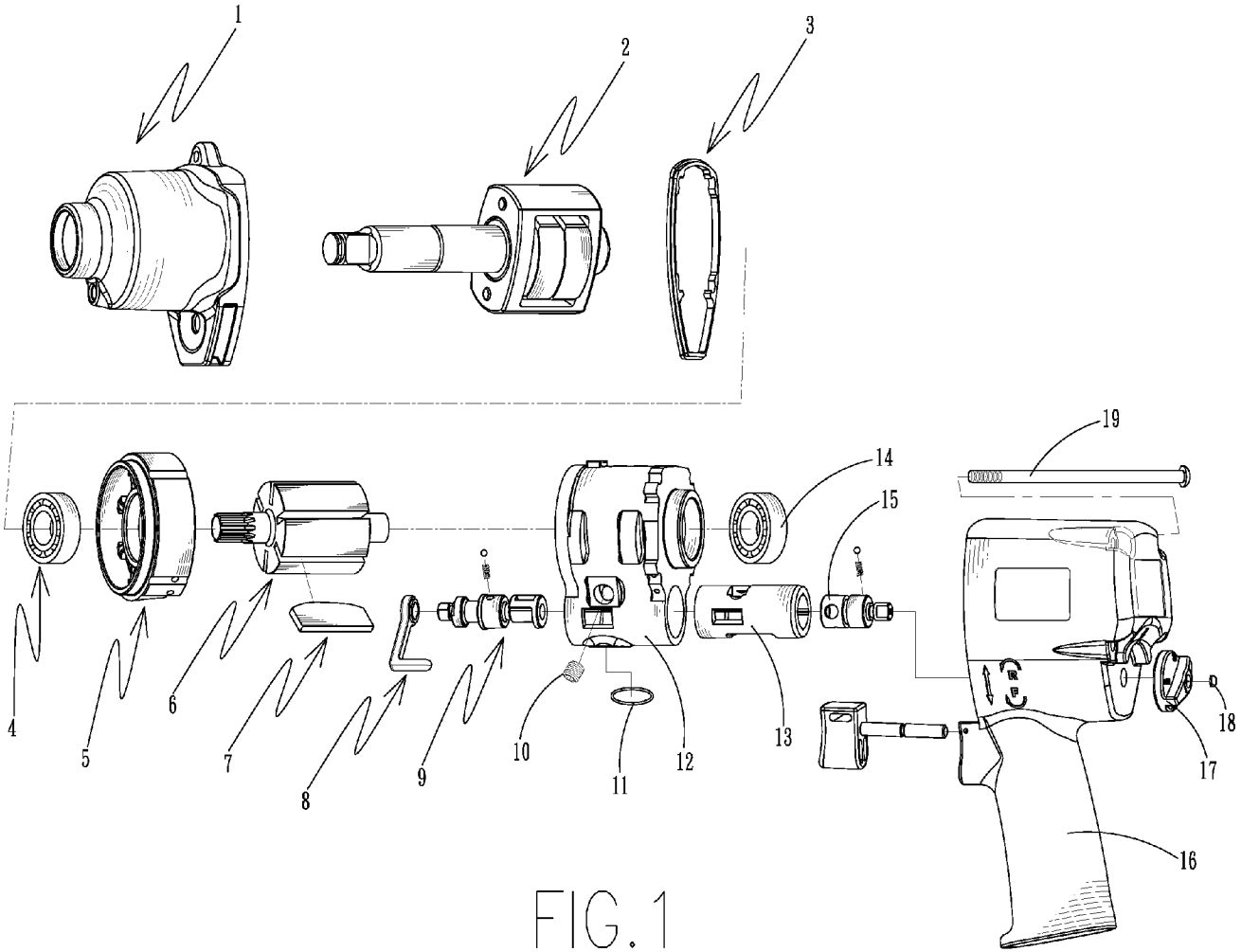
FIG. 1 is an exploded view according to a preferred embodiment of the present invention.

As shown in FIG. 1, a compact one touch pneumatic wrench according to a first embodiment of the present invention comprises a front cover 1, a percussion assembly 2, a gasket 3, a front bearing 4, a front end cap 5, a rotor 6, blades 7, a swing member 8, a rotating valve 9, a fastener 10, a washer 11, a cylinder 12, an air valve sleeve 13, a rear bearing 14, a speed adjusting valve 15, a housing 16, a speed adjusting button 17, a fastening bolt 18 and a connecting bolt 19. A rear end of a central axle of the percussion assembly 2 is connected with the front bearing 4. The front bearing 4 is inserted into a central hole of the front end cap 5. A front end of the rotor 6 is inserted through the front bearing 4 and into a hole of the rear end of the central axle of the percussion assembly 2. The rotor 6 drives the percussion assembly 2 to rotate together. The blades 7 are inserted into grooves on an outer wall of the rotor 6. A front end surface of the cylinder 12 is sealedly connected to the front end cap 5 to form a sealed chamber to seal the rotor 6 and the blades 7 therein. A rear end of a central axle of the rotor 6 is extended out of a central hole of the cylinder 12, and the rear bearing 14 is fitted thereon. A front end of the central axle of the percussion assembly 2 is extended out of a hole of the front cover 1. The housing 16 is connected to the front cover 1 with four connecting bolts 19 and all the parts are enclosed between the front cover 1 and the housing 16. The cylinder 12 has an air valve sleeve hole 20 for insertion of the air valve sleeve 13 to achieve a tight connection. One end of the speed adjusting valve 15 is formed with a speed adjustment air inlet 36 and inserted in the air valve sleeve 13, and an opposite end of the speed adjusting valve 15 is extended out of the housing 16 and connected to the adjusting button 17 through the fastening bolt 18, so that the adjusting button 17 can be turned to adjust the speed. One end of the rotating valve 9 is formed with an air inlet 38 and inserted in the air valve sleeve 13, and an opposite end of the rotating valve 9 is inserted in the front cover 1. By swaying the swing member 8, the rotating valve 9 cooperates with the swing member 8 to switch the clockwise/counterclockwise rotation of the motor. By the aforesaid structure, the compact one touch pneumatic wrench of the present invention is completed.

Figure 2:
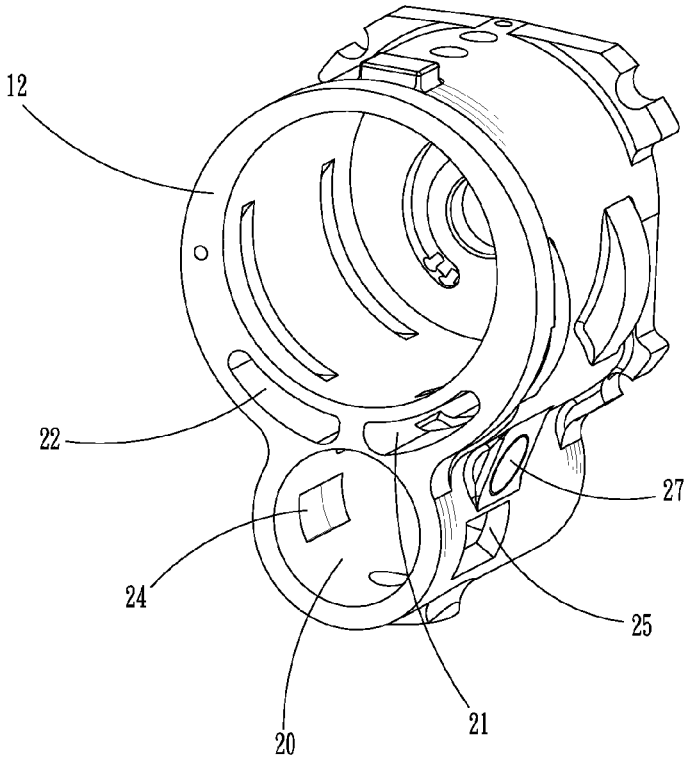
FIG. 2 is a perspective view of a cylinder according to the preferred embodiment of the present invention.
Figure 3:
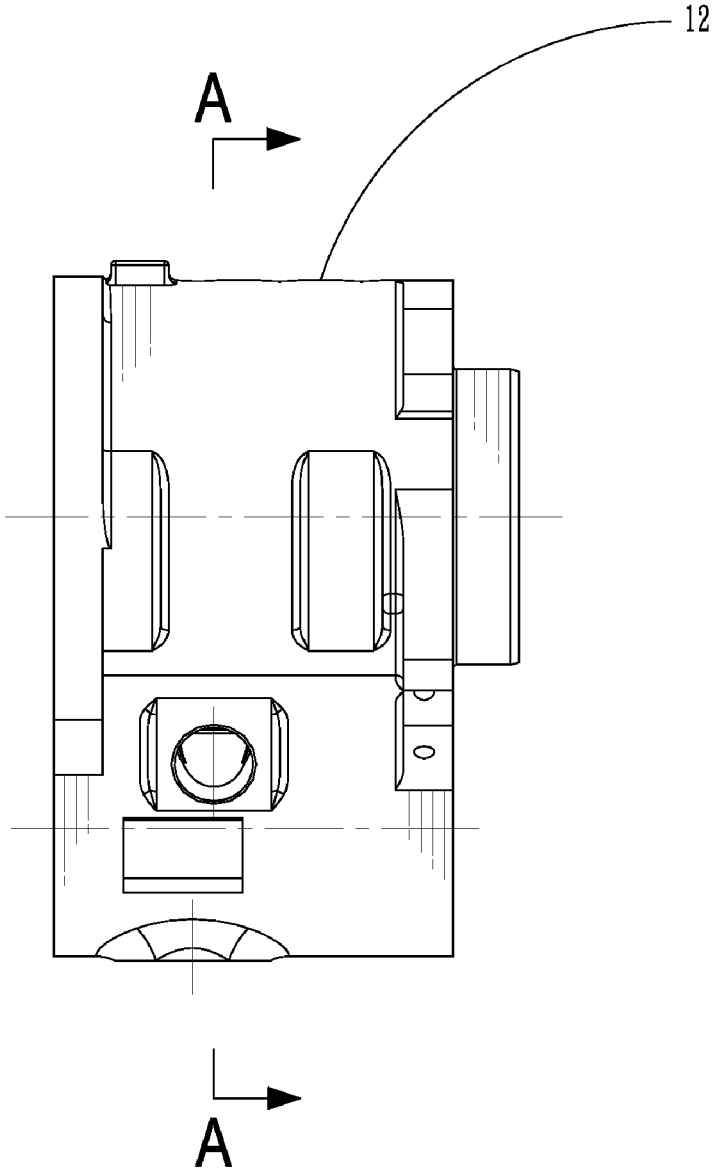
FIG. 3 is a left side view of the cylinder according to the preferred embodiment of the present invention.
Figure 3A:
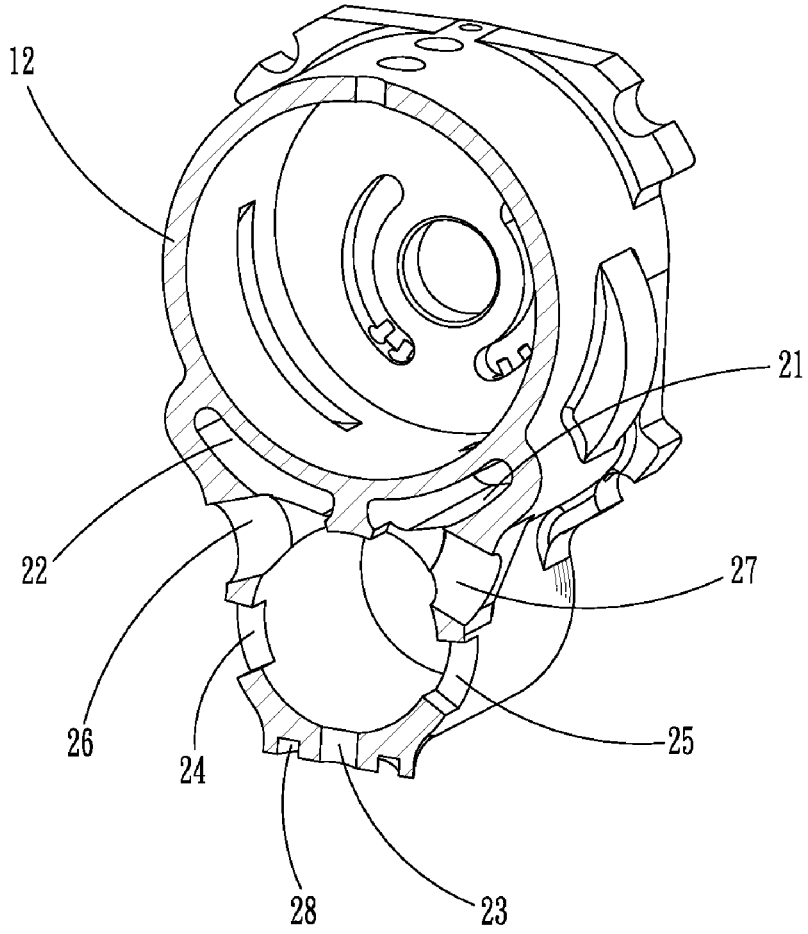
FIG. 3A is a perspective and sectional view of the cylinder according to the preferred embodiment of the present invention.
Figure 4:
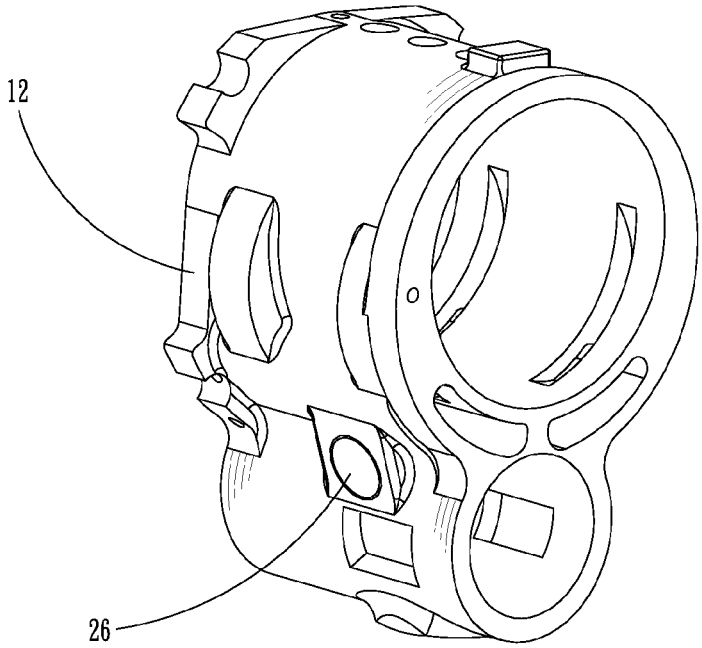
FIG. 4 is a rear view of the cylinder according to the preferred embodiment of the present invention.

Referring to FIG. 2 to FIG. 4, the cylinder 12 has a circular hole at a rear end thereof, and the air valve sleeve hole 20, a clockwise rotation air slot 21, a counterclockwise rotation air slot 22, a first air outlet 24, a second air outlet 25, a first through hole 26, a second through hole 27, a bottom air inlet 23 and a sealed groove 28 are disposed in the cylinder 12. The first through hole 26 and the second through hole 27 are tightly sealed through the fastener 10. The clockwise rotation air slot 21 and the counterclockwise rotation air slot 22 communicate with the chamber. The first through hole 26 communicates with the counterclockwise rotation air slot 22. The second through hole 27 communicates with the clockwise rotation air slot 21. The first air outlet 24, the second air outlet 25 and the bottom air inlet 23 communicate with the air valve sleeve hole 20. The bottom air inlet 23 is surrounded by the sealed groove 28 and sealed by the washer 11. The cylinder 12 engages with the housing 16 tightly.

Figure 5:
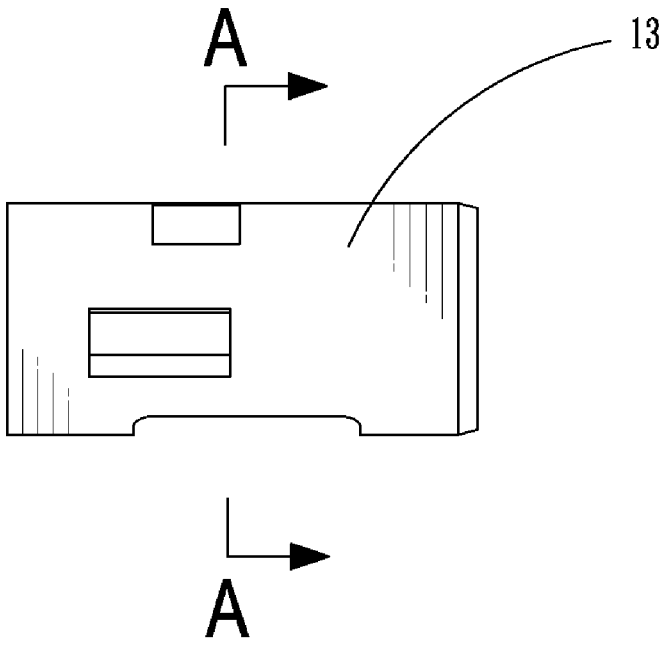
FIG. 5 is a left side view of an air valve sleeve according to the preferred embodiment of the present invention.
Figure 5A:
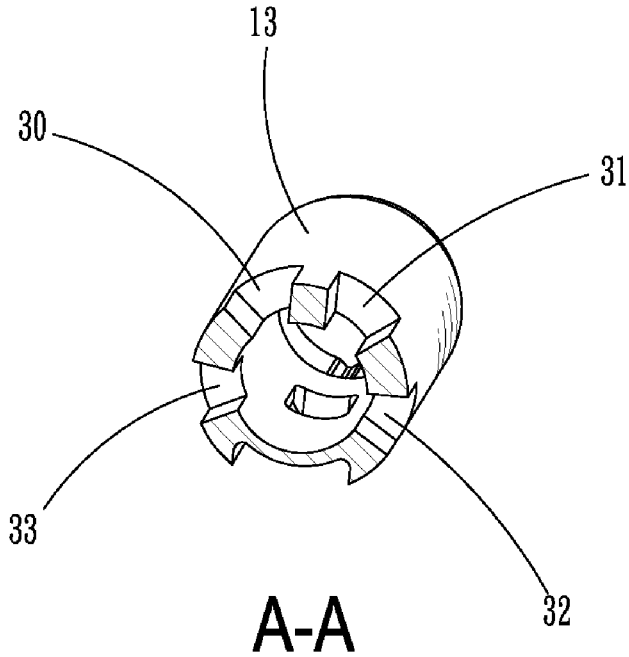
FIG. 5A is a left side sectional view of the air valve sleeve according to the preferred embodiment of the present invention.
Figure 6:
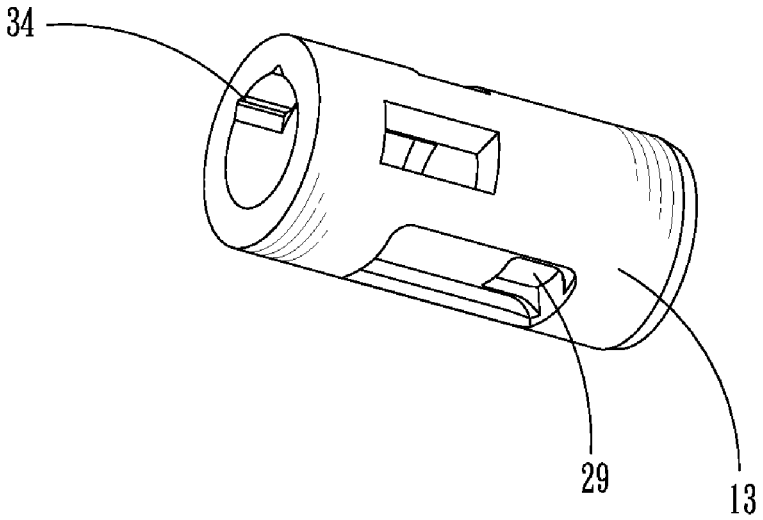
FIG. 6 is a perspective view of the air valve sleeve according to the preferred embodiment of the present invention.
Figure 7:
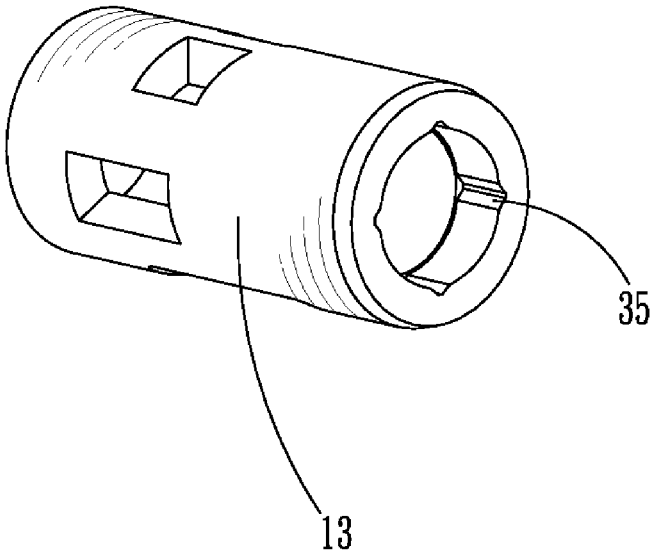
FIG. 7 is a right side view of the air valve sleeve according to the preferred embodiment of the present invention.

Referring to FIG. 5 to FIG. 7, the air valve sleeve 13 has a counterclockwise rotation air inlet 30, a clockwise rotation air inlet 31, a first air vent 33, a second air vent 32, and an air intake 29. The air valve sleeve 13 has toothed limit troughs at two sides thereof. The air valve sleeve 13 is disposed in the air valve sleeve hole 20 of the cylinder 12. The counterclockwise rotation air inlet 30 communicates with the counterclockwise rotation air slot 22 of the cylinder 12. The clockwise rotation air inlet 31 communicates with the clockwise rotation air slot 21 of the cylinder 12. The first air vent 33 communicates with the first air outlet 24 of the cylinder 12. The second air vent 32 communicates with the second air outlet 25 of the cylinder 12. The air intake 29 communicates with the bottom air inlet 23 of the cylinder 12.

Figure 8:
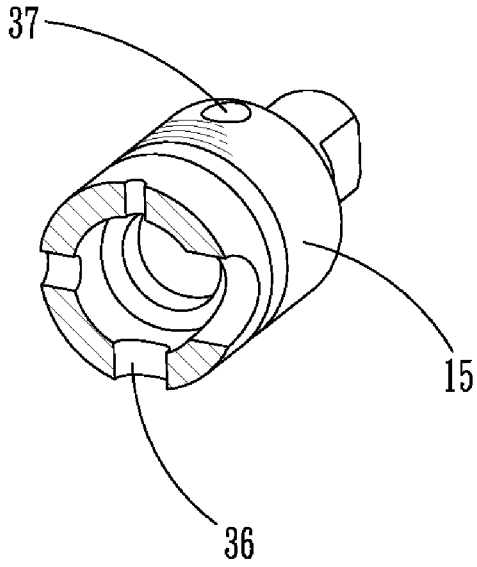
FIG. 8 is a perspective and sectional view of a speed adjusting valve according to the preferred embodiment of the present invention.

Referring to FIG. 8, the speed adjusting valve 15 has four speed adjustment air inlets 36 to communicate with the air intake 29 of the air valve sleeve 13 so as to control the air inflow to adjust the speed. The speed adjusting valve 15 has a steel ball hole 37 corresponding to a speed adjustment limit groove 35 at a right side of the air valve sleeve 13 to control an accurate speed adjustment.

Figure 9:
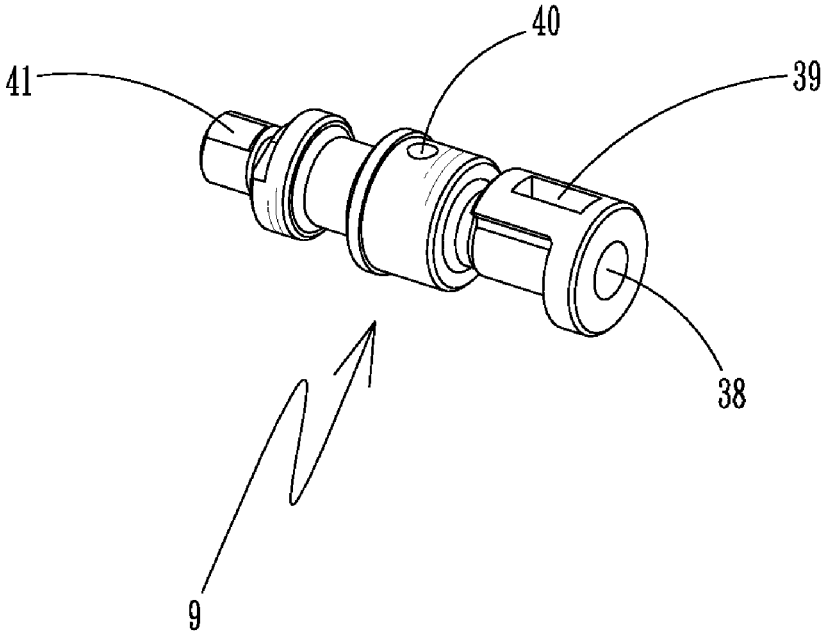
FIG. 9 is a perspective view of a rotating valve according to the preferred embodiment of the present invention.

Referring to FIG. 9, the rotating valve 9 has an air inlet 38, an air outlet 39, a steel ball hole 40 and an engaging portion 41. The air passes through the speed adjustment air inlets 36 of the speed adjusting valve 15 into the air inlet 38 of the rotating valve 9. The air inlet 38 communicates with the air outlet 39. By swaying the swing member 8, the air outlet 39 of the rotating valve 9 communicates with the clockwise rotation air inlet 31 or the counterclockwise rotation air inlet 30 to switch the clockwise/counterclockwise rotation of the motor.

Figure 10:
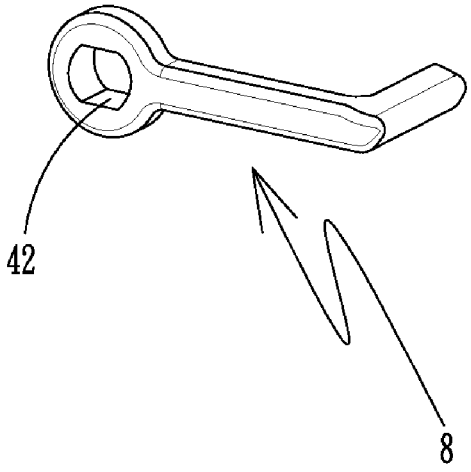
FIG. 10 is a perspective view of a swing member according to the preferred embodiment of the present invention.

As shown in FIG. 10, the swing member 8 has an engaging hole 42 corresponding to the engaging portion 41 of the rotating valve 9 to achieve a link motion, such that the swing member 8 can be swayed with the thumb of the hand holding the handle to switch the clockwise/counterclockwise rotation of the motor, providing one touch function.

Figure 11:
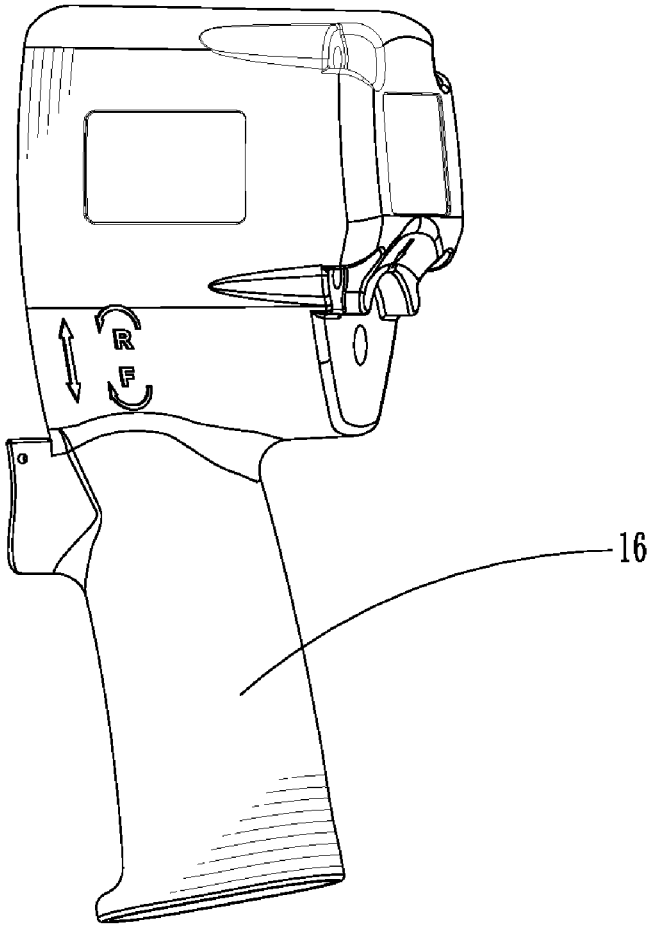
FIG. 11 is a perspective view of a housing according to the preferred embodiment of the present invention.

As shown in FIG. 11, the housing 16 is made of engineering plastic material.

Figure 12:
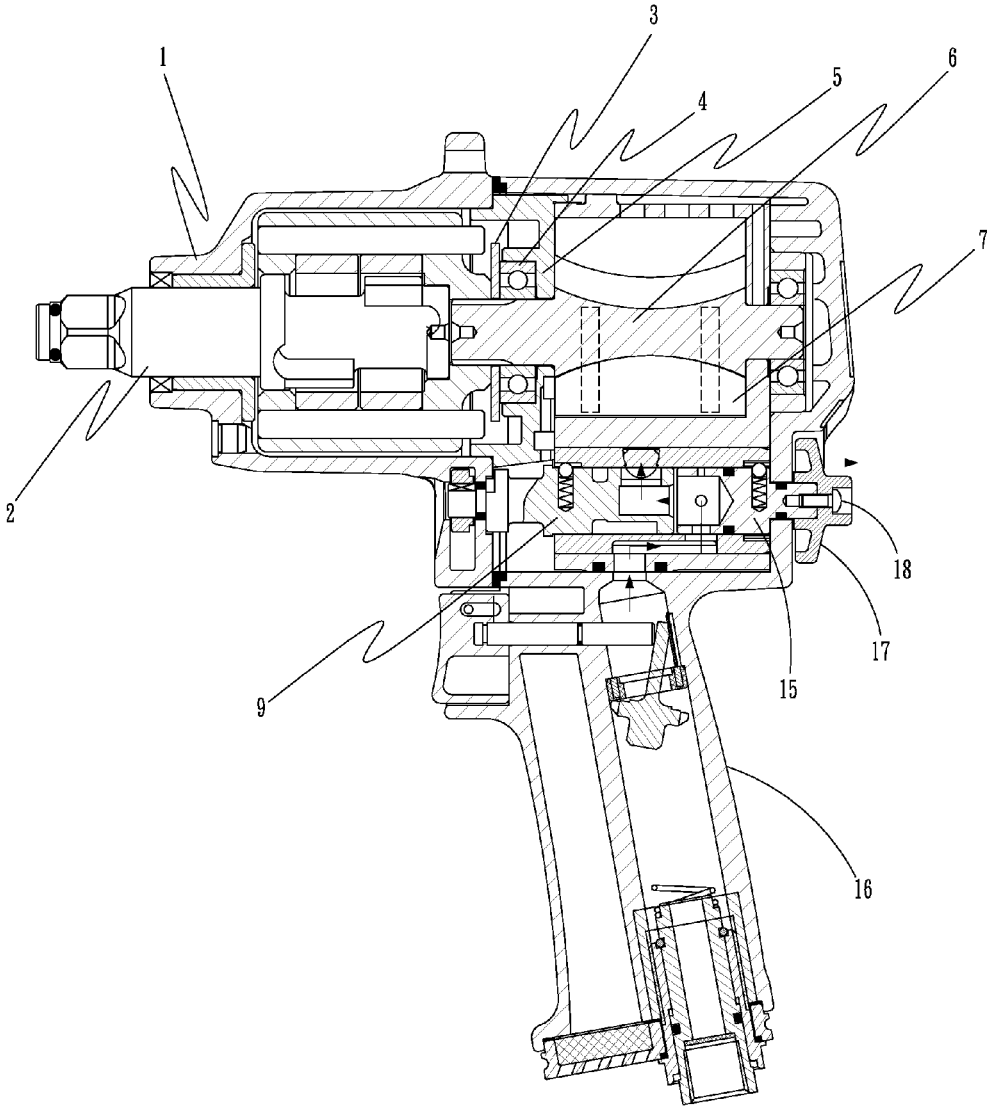
FIG. 12 is a cross-sectional view of the preferred embodiment of the present invention in a counterclockwise rotation status.
Figure 12A:
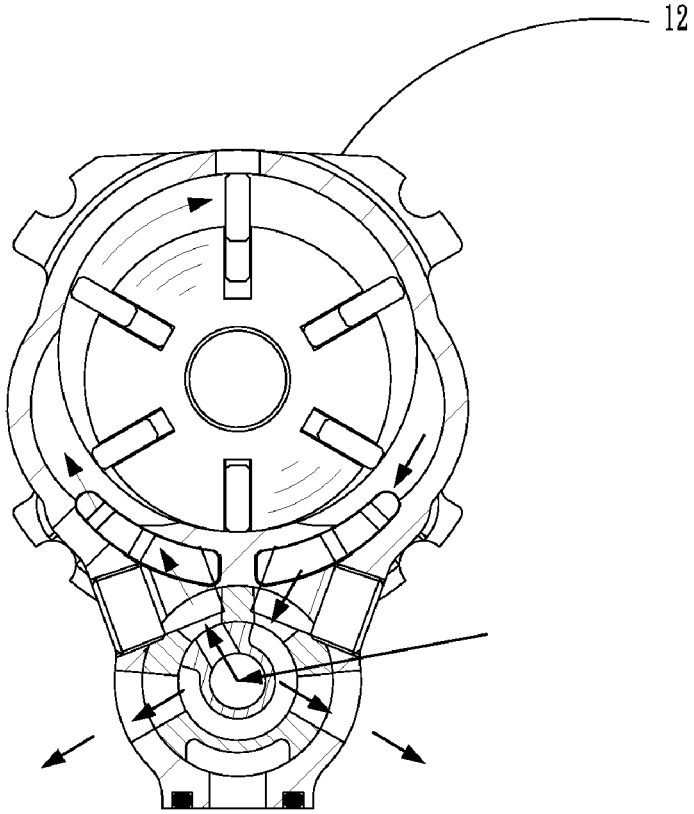
FIG. 12A is a cross-sectional view of a motor according to the preferred embodiment of the present invention.
Figure 13:
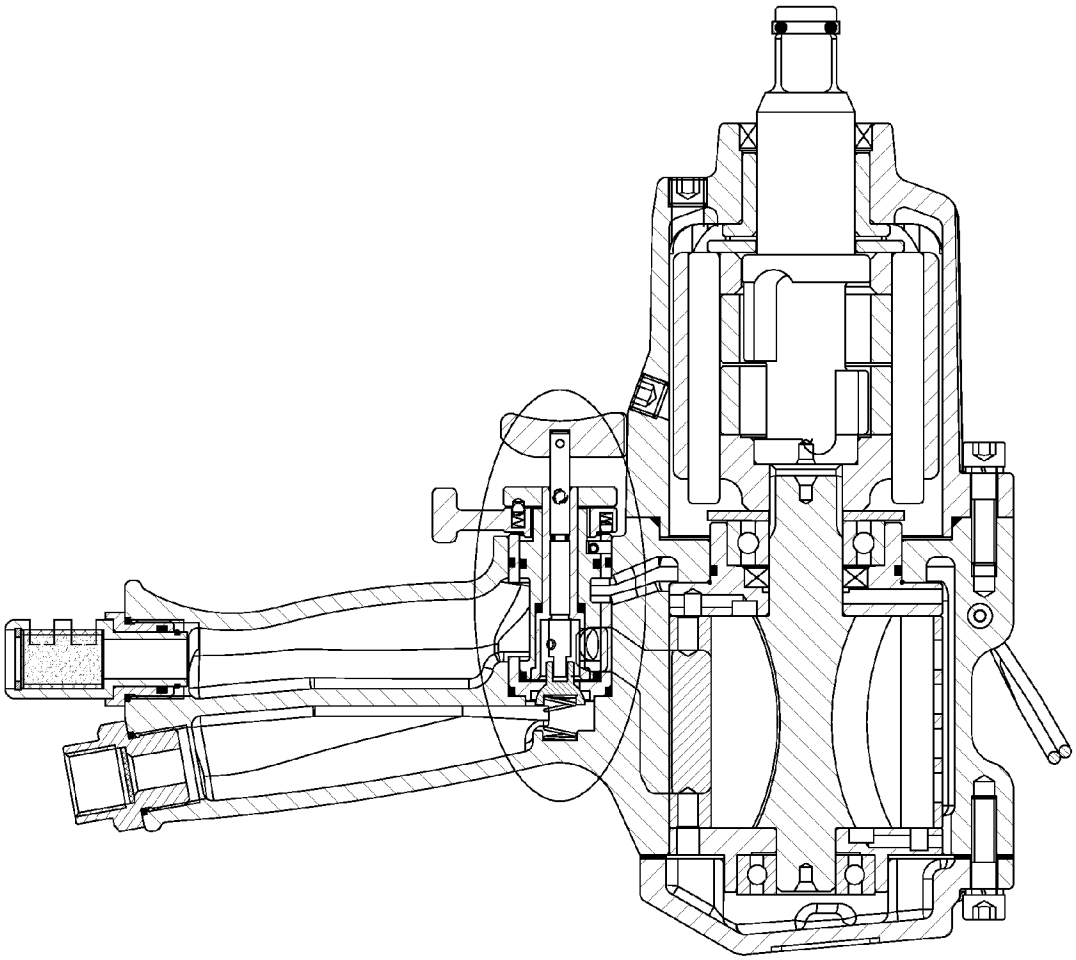
PRIOR ART FIG. 13
FIG. 13 is a cross-sectional view of a conventional pneumatic wrench.

FIG. 12 and FIG. 12A are schematic views to show the airflow when the present invention is turned counterclockwise. The compressed air enters the housing 16 to pass through the bottom air inlet 23 of the cylinder 12 and the air intake 29 at the bottom of the air valve sleeve 13 and into the air inlet 38 of the rotating valve 9 through one of the speed adjustment air inlets 36 of the speed adjusting valve 15, and then flows out from the air outlet 39 of the rotating valve 9. When the air outlet 39 of the rotating valve 9 communicates with the counterclockwise rotation air inlet 30 of the air valve sleeve 13 by swaying the swing member 8, the air flows into the cylinder 12. Due to the eccentric function, the flow pushes the blades 7 and the rotor 6 to turn counterclockwise, which drives the percussion assembly 2 to carry out percussion. When the blades 7 are turned to the highest point of the cylinder 12, the air will be exhausted. Because the clockwise rotation air slot 21 of the cylinder 12 communicates with the chamber of the cylinder 12, the air passes through the clockwise rotation air slot 21, the clockwise rotation air inlet 31 of the air valve sleeve 13 and the predetermined space of the rotating valve 9, and then flows out from the second air vent 32 of the air valve sleeve 13, the second air outlet 25 of the cylinder 12, the first air vent 33 of the air valve sleeve 13, the first air outlet 24 of the cylinder 12, and the exhaust passage of the housing 16, so that the entire mechanism can be turned continually. If a clockwise rotation is desired, the thumb of the hand holding the handle sways the swing member 8 for the air outlet 39 of the rotating valve 9 to communicate with the clockwise rotation air inlet 31 of the air valve sleeve 13. The work principle is identical to the aforesaid.

Compared to the conventional wrench which needs one hand to hold the handle and the other hand to operate the clockwise/counterclockwise rotation of the motor, the present invention improves the air passage of the cylinder to provide a simple and convenient operation with only one hand.

The advantages of the present invention are as follows:

1. Saving energy: The cylinder, the speed adjustment and rotating mechanism of the pneumatic wrench are integrated, having a good airtight function and being compact in construction, so that the loss of the compressed air can be decreased to save energy.
2. One touch function: The pneumatic wrench can be operated with ease, with only one hand to hold the handle and to operate the clockwise/counterclockwise rotation of the motor.
3. Having a compact construction: The pneumatic wrench uses the plastic housing so the entire construction is light and compact.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A compact one touch pneumatic wrench, comprising a front cover, a percussion assembly, a gasket, a front bearing, a front end cap, a rotor, blades, a swing member, a rotating valve, a fastener, a washer, a cylinder, an air valve sleeve, a rear bearing, a speed adjusting valve, a housing, a speed adjusting button, a fastening bolt and a connecting bolt; a rear end of a central axle of the percussion assembly being connected with the front bearing; the front bearing being inserted into a central hole of the front end cap; a front end of the rotor being inserted through the front bearing and into a hole of the rear end of the central axle of the percussion assembly, the rotor driving the percussion assembly to rotate together; the blades being inserted into grooves on an outer wall of the rotor, a front end surface of the cylinder being sealedly connected to the front end cap to form a sealed chamber to seal the rotor and the blades therein; a rear end of a central axle of the rotor being extended out of a central hole of the cylinder and the rear bearing being fitted thereon; a front end of the central axle of the percussion assembly being extended out of a hole of the front cover, the housing being connected to the front cover with four connecting bolts; the cylinder having an air valve sleeve hole for insertion of the air valve sleeve to achieve a tight connection, one end of the speed adjusting valve being formed with a speed adjustment air inlet and inserted in the air valve sleeve, and an opposite end of the speed adjusting valve being extended out of the housing and connected to the adjusting button through the fastening bolt so that the adjusting button is turned to adjust the speed; one end of the rotating valve being formed with an air inlet and inserted in the air valve sleeve and an opposite end of the rotating valve being inserted in the front cover, by swaying the swing member, the rotating valve cooperating with the swing member to switch a clockwise/counterclockwise rotation of a motor.

2. The compact one touch pneumatic wrench as claimed in claim 1, wherein the cylinder has a circular hole at a rear end thereof, the air valve sleeve hole, a clockwise rotation air slot, a counterclockwise rotation air slot, a first air outlet, a second air outlet, a first through hole, a second through hole, a bottom air inlet and a sealed groove being disposed in the cylinder; the first through hole and the second through hole being tightly sealed through the fastener, the clockwise rotation air slot and the counterclockwise rotation air slot communicating with the chamber; the first through hole communicating with the counterclockwise rotation air slot; the second through hole communicating with the clockwise rotation air slot; the first air outlet, the second air outlet and the bottom air inlet communicating with the air valve sleeve hole; the bottom air inlet being surrounded by the sealed groove and sealed by the washer, the cylinder engaging with the housing tightly.

3. The compact one touch pneumatic wrench as claimed in claim 2, wherein the air valve sleeve having a counterclockwise rotation air inlet, a clockwise rotation air inlet, a first air vent, a second air vent and an air intake, the air valve sleeve having toothed limit troughs at two sides thereof; the air valve sleeve being disposed in the air valve sleeve hole of the cylinder, the counterclockwise rotation air inlet communicating with the counterclockwise rotation air slot of the cylinder, the clockwise rotation air inlet communicating with the clockwise rotation air slot of the cylinder, the first air vent communicating with the first air outlet of the cylinder, the second air vent communicating with the second air outlet of the cylinder, the air intake communicating with the bottom air inlet of the cylinder.

4. The compact one touch pneumatic wrench as claimed in claim 3, wherein the speed adjusting valve has four speed adjustment air inlets to communicate with the air intake of the air valve sleeve so as to control the air inflow for adjusting the speed, the speed adjusting valve having a steel ball hole corresponding to a speed adjustment limit groove at a right side of the air valve sleeve to control an accurate speed adjustment.

5. The compact one touch pneumatic wrench as claimed in claim 4, wherein the rotating valve has the air inlet, an air outlet, a steel ball hole and an engaging portion, the air passing through the speed adjustment air inlets of the speed adjusting valve into the air inlet of the rotating valve, the air inlet communicating with the air outlet, by swaying the swing member, the air outlet of the rotating valve communicating with the clockwise rotation air inlet or the counterclockwise rotation air inlet to switch the clockwise/counterclockwise rotation of the motor.

6. The compact one touch pneumatic wrench as claimed in claim 1, wherein the swing member has an engaging hole corresponding to an engaging portion of the rotating valve to achieve a link motion, such that the swing member is swayed with the thumb of the hand holding a handle to switch the clockwise/counterclockwise rotation of the motor.

7. The compact one touch pneumatic wrench as claimed in claim 1, wherein the housing is made of engineering plastic material.

* * * * *